United States Patent [19]

Kielhorn et al.

[11] 4,090,058

[45] May 16, 1978

[54] CONDUCTIVE HEATING DEVICE

[75] Inventors: Werner Kielhorn, Essen-Steele; Gerhard Heyduk, Dortmund-Scharnhorst, both of Germany; Otto Hochstrasser, North Brunswick, N.J.

[73] Assignee: Brown, Boveri & Cie Aktiengesellschaft, Mannheim, Germany

[21] Appl. No.: 680,046

[22] Filed: Apr. 26, 1976

[30] Foreign Application Priority Data

Apr. 26, 1975 Germany ..... 2518664

[51] Int. Cl.[2] ..... C21D 9/62

[52] U.S. Cl. ..... 219/156; 219/155

[58] Field of Search ..... 219/50, 155, 156, 161, 219/118; 148/150, 154; 266/104, 114; 336/174, 175

[56] References Cited

U.S. PATENT DOCUMENTS

| | | | |
|---|---|---|---|
| 2,931,892 | 4/1960 | Stich et al. | 219/156 |
| 3,294,948 | 12/1966 | Fegley et al. | 219/161 X |
| 3,419,701 | 12/1968 | Stengel et al. | 219/156 |
| 3,427,430 | 2/1969 | Trautman et al. | 219/155 |
| 3,929,524 | 12/1975 | Filatov et al. | 219/118 X |

*Primary Examiner*—C. L. Albritton
*Assistant Examiner*—N. D. Herkamp
*Attorney, Agent, or Firm*—Herbert L. Lerner

[57] ABSTRACT

In apparatus for resistance-heating elongated workpieces by direct passage of current therethrough, a device for displacing the elongated workpieces longitudinally into and out of the apparatus includes rail means providing a transporting surface into and out of the apparatus, electrode carriers having rollers rollably supporting the electrode carriers on the rail means, and drive means for driving the electrode carriers along the rail means in axial direction of a respective workpiece.

3 Claims, 12 Drawing Figures

CONDUCTIVE HEATING DEVICE

The invention relates to a device for resistance-heating elongated workpieces, such as in the form of bars, tubs or the like, by direct passage of current therethrough, wherein the workpieces are introduced and withdrawn through longitudinal displacement thereof by means of a roller bed or similar transporting device.

In heretofore known apparatus of this general type that has found practical acceptance, such as that of German Published Prosecuted Application DT-AS No. 1,240,105, it was necessary to provide for the electrode carriers lowerable support frames erected in a pit, so that the carriers can be removed from the travel path of the work pieces in order to displace the workpieces in the longitudinal direction thereof at a low elevation above the floor of a plant or shop. Furthermore, in the heretofore constructed apparatus of this general type, a custom-made and costly transformer has always been used, which was specifically designed for each installation in accordance with the cross section and the length of the workpiece. The transformer then stood closely beside or below the workpiece to be heated, in order to have the shortest possible leads from the secondary winding of the transformer to the current-carrying electrodes which were applied to the ends of the workpiece, so as to close the secondary circuit of the transformer.

It is an object of the invention to provide a conductive heating apparatus, in which neither complex lowerable support frames are required for the electrode carriers nor a pit for accomodating the same.

With the foregoing and other objects in view, there is provided, in accordance with the invention, in apparatus for resistance-heating elongated workpieces by direct by direct passage of current therethrough, a device for displacing the elongated workpieces longitudinally into and out of the apparatus comprising rail means providing a transporting surface into and out of the apparatus, electrode carriers having rollers rollably supporting the electrode carries on the rail means, and drive means for driving the electrode carriers along the rail means in axial direction of a respective workpiece.

In accordance with another feature of the invention, when a light workpiece of relatively small cross section is heated continuously i.e. once-through, and the length of the section being heated is adjustable, that rail means for the rollers of the electrode carriers, which are displaceable in axial direction of the workpiece by the drive means, are either supported on the work floor of the shop or plant, or are carried by a support frame which is attached to arms that extend respectively from a plurality of support structures.

In accordance with a further and alternate feature of the invention, when heavy workpieces with relatively large cross sections are to be heated cyclically i.e. batch-like periodically, the electrode carriers carry electrodes that are engageable with the end faces of the workpiece, and respective arms extend from lifting columns which are vertically displaceable in a plurality of respective support structures, a support frame being fastened to the arms and carrying the rail means on which the rollers of the electrode carriers rollably support the electrode carriers, which are displaceable in axial direction of the workpiece by the drive means.

In order to move the lifting columns relatively easily and reliably within the respect support structures, in accordance with yet another feature of the last-mentioned embodiment of the invention, which is employed for cyclic operation, the lifting columns have guide rollers for guiding the same in the support structures, respectively, and are movable upwardly and downwardly by means of respective differential cylinders.

In order to attain at all times the correct position for workpieces of varying cross-sectional shapes and dimensions with respect to roll-type electrodes, in an apparatus wherein the workpieces are being heated continuously or once-through and the electrode carriers are disposed at a fixed elevation, in accordance with an added feature of the invention, the electrode carriers are formed with respective cutouts, and respective guide rollers for the workpieces are disposed in the cutouts and are adjustable in elevation therewithin.

In contrast thereto, the electrode carriers for apparatus performing a cyclic operation, and which are adjustable in elevation by means of the lifting columns, are provided, in accordance with an alternate feature of the invention, with respective workpiece guide rollers that are fixedly disposed within respective recesses formed in the electrode carriers.

Instead of the heretofore known transformers, which were specially designed and constructed for each heating apparatus and which had a number of secondary windings corresponding to the electrode pairs engaging the ends of the workpiece, there are provided, in accordance with another feature of the invention, a plurality of serially disposed transformers of equal power rating formed with respective windows having centers disposed on an axis coinciding with the longitudinal axis of a workpiece when the latter is being resistance-heated in the apparatus, transformers having primary winding on opposite legs thereof, the workpiece extending through the windows of the transformers and being connected at the ends thereof to one another by electrodes engaging therewith as well as flexible conductor elements and tubular current conductors constituting together therewith secondary windings for the transformers, said tubular current conductors being disposed substantially parallel to the longitudinal axis of the workpiece and being located outside the transformers at a minimal proximate distance therefrom.

For the purpose of fastening and spacing the tubular current conductors in the resistance-heating apparatus, there are provided in accordance with a further feature of the invention, means for carrying the tubular current conductors, such as stands or holders, having insulating bodies respectively holding the tubular current conductors in place on the carrying means.

To protect the transformer windings against excessive heating by the highly heated workpiece and to minimize heat loss due to radiation, the transformers, in accordance with a concomitant feature of the invention, are provided with thermal insulation within the windows thereof in vicinity of the respective primary windings for insulating the latter with respect to the workpiece.

Other features which are considered as characteristic for the invention are set forth in the appended claims.

Although the invention is illustrated and described herein as embodied in a conductive heating device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
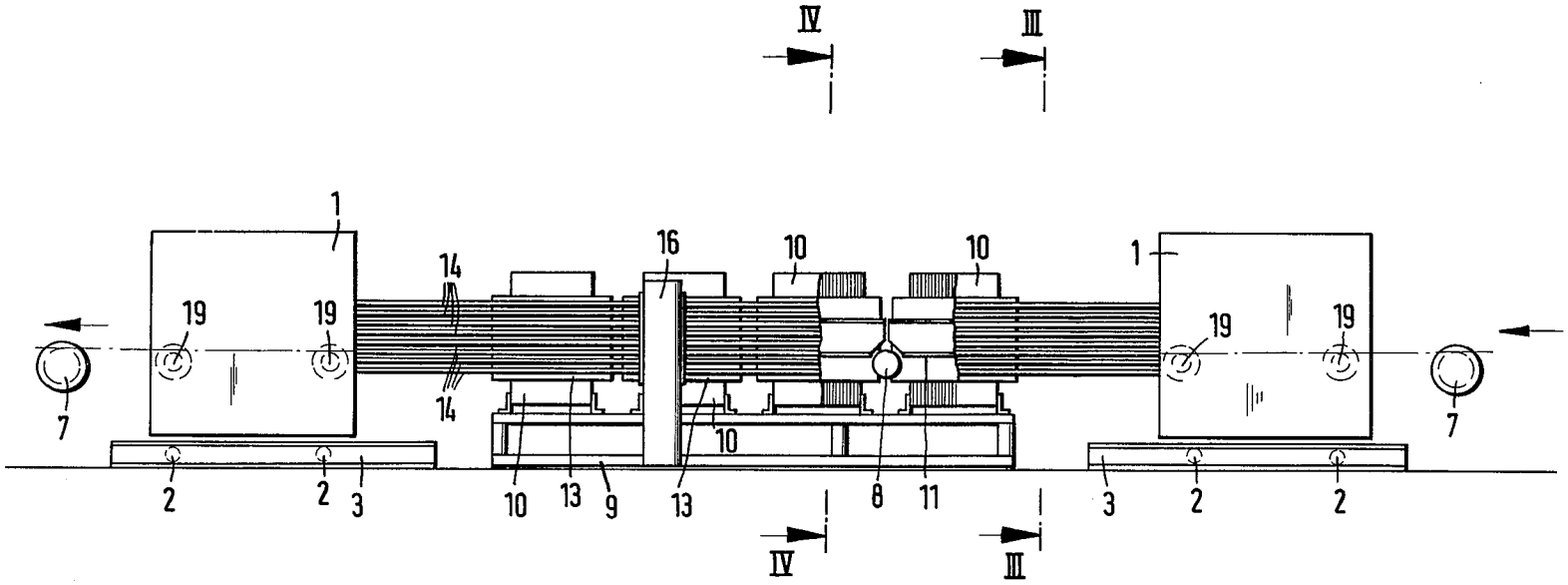
FIGS. 1 and 2 are side elevational and top plan views, respectively, of one embodiment of the conductive heating apparatus of the invention wherein the electrode carriers are disposed on the shop floor so as to be able to travel in axial direction of the workpiece.
Figure 2:
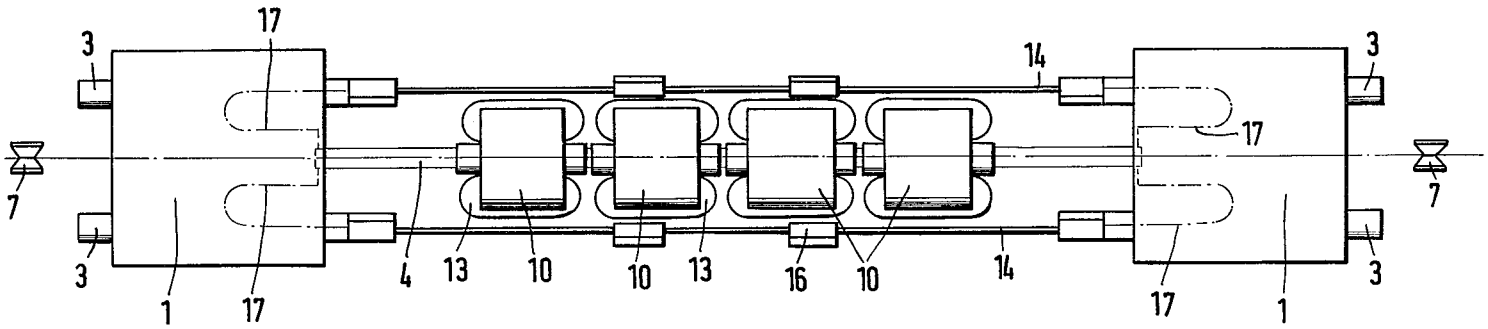
Figure 5:
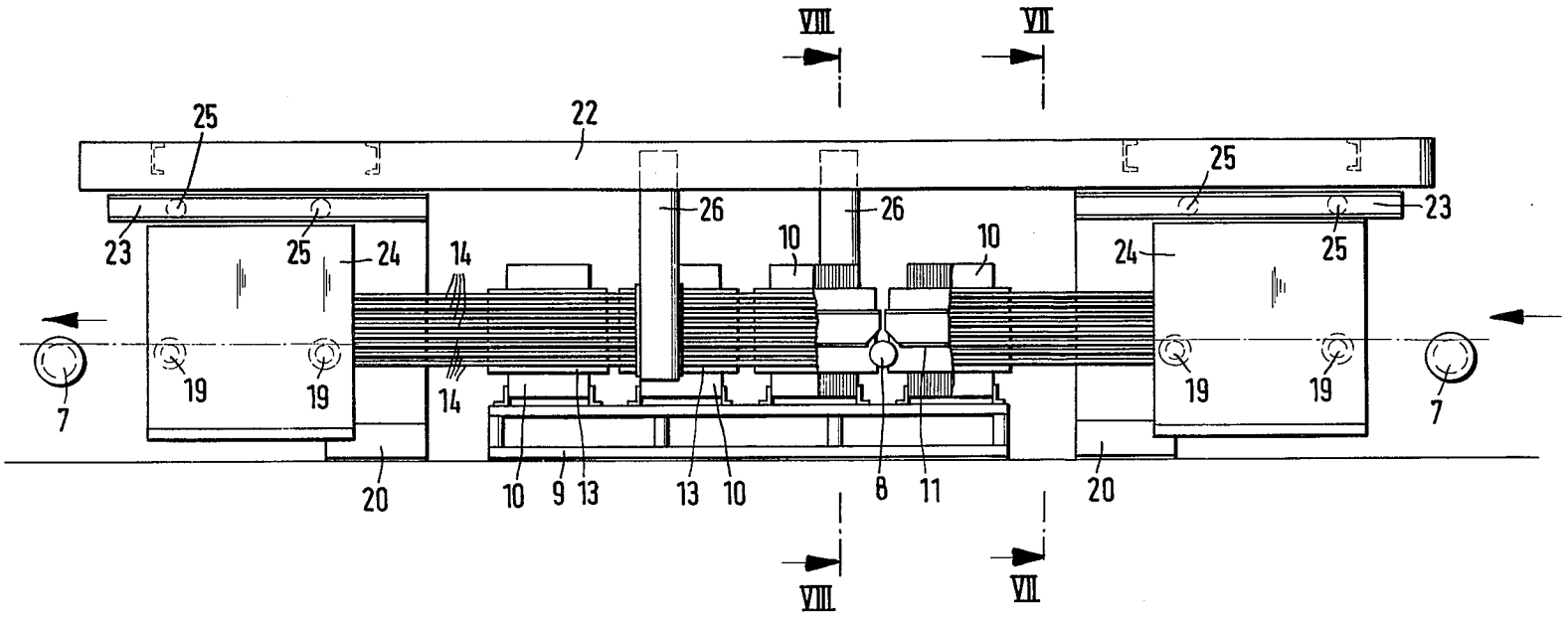
Figure 6:
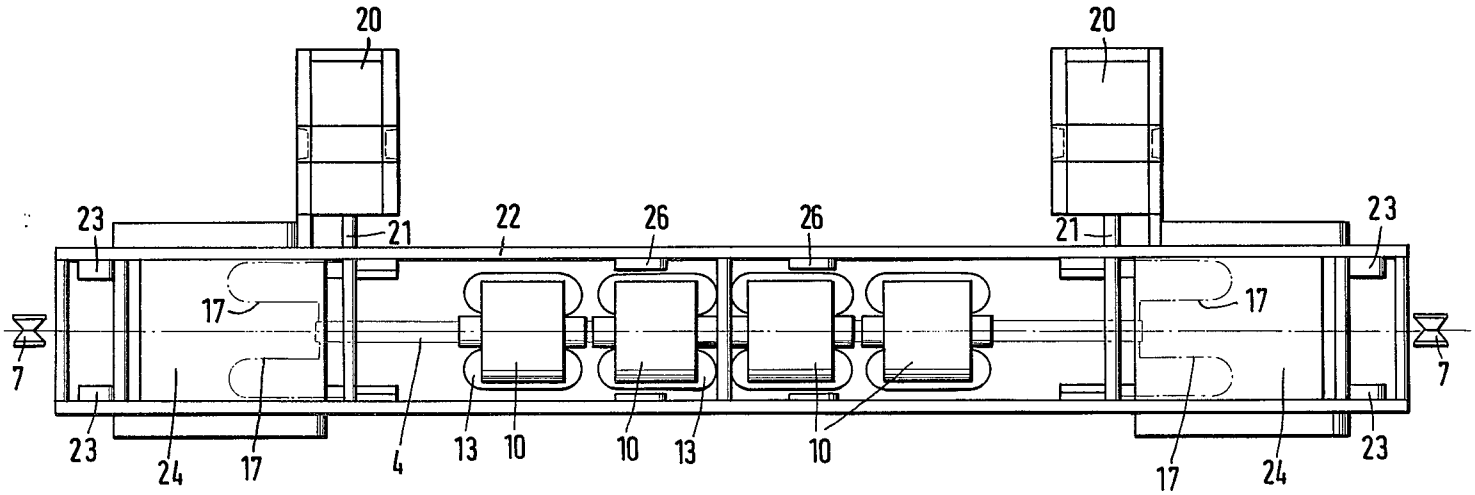
Figure 7:
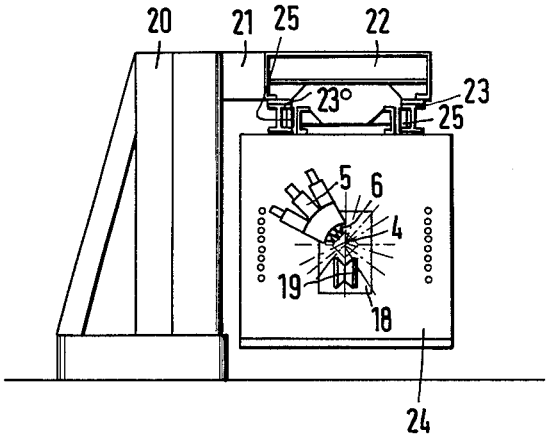
Figure 8:
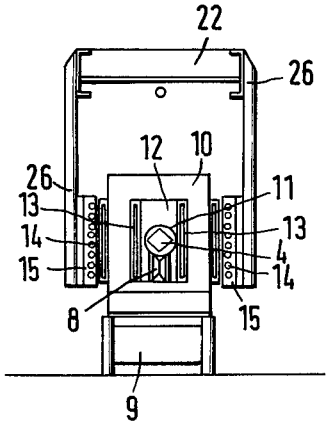
Figure 9:
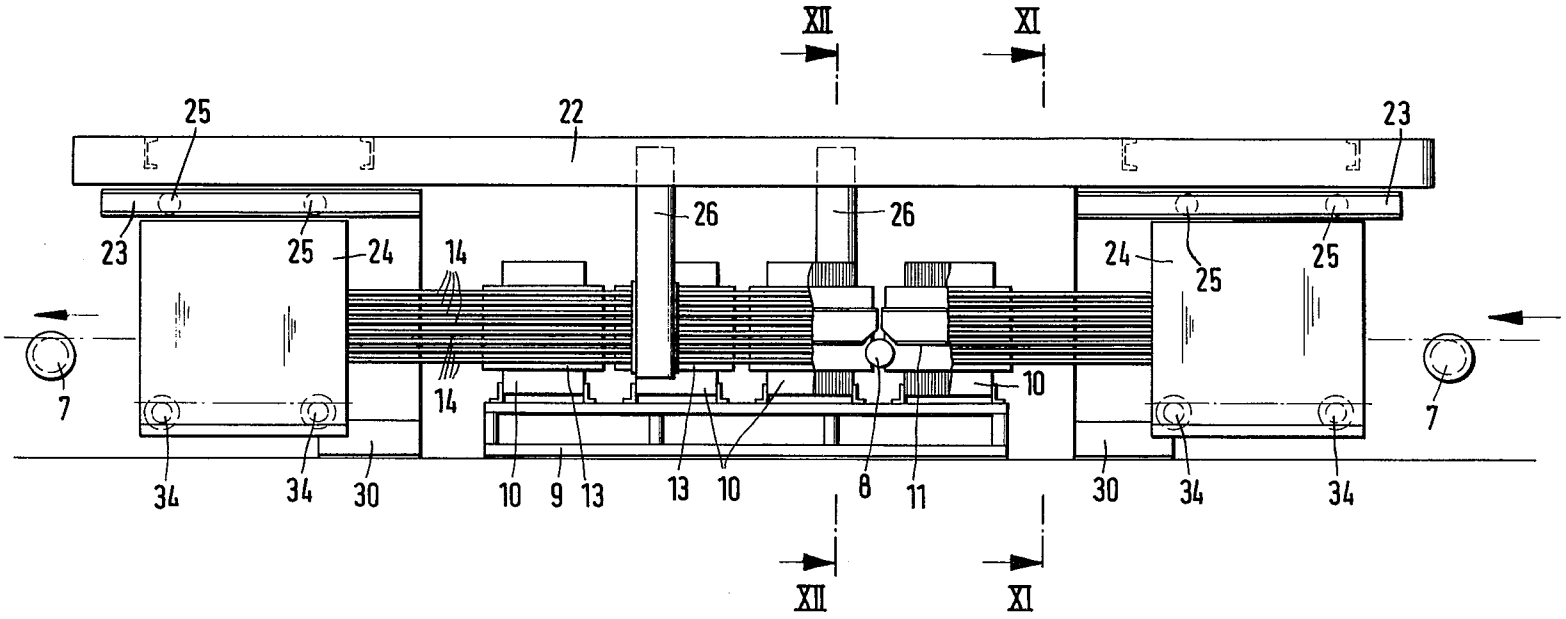
Figure 10:
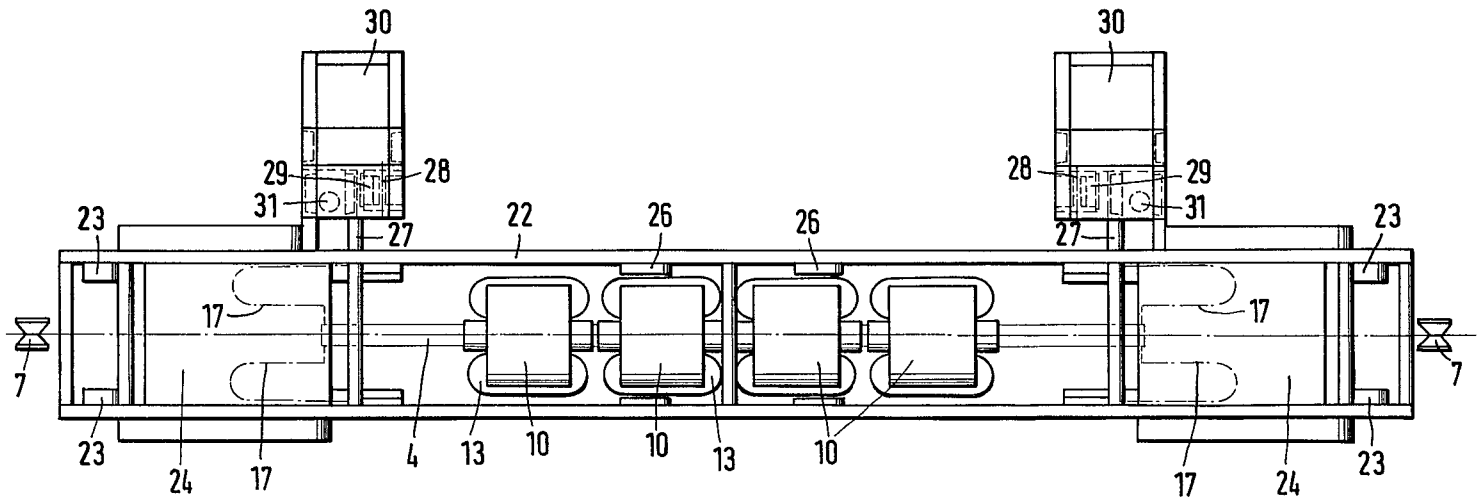
Figure 11:
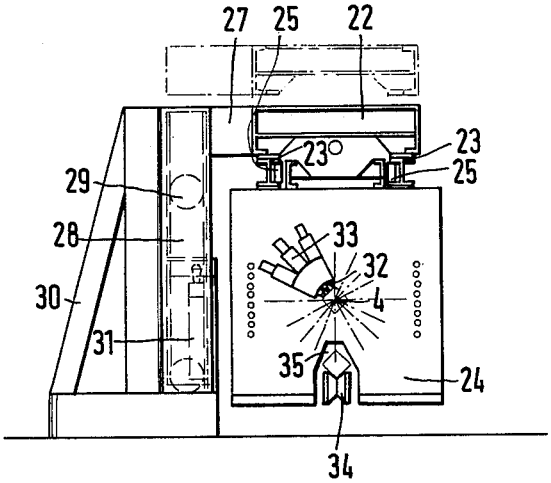
Figure 12:
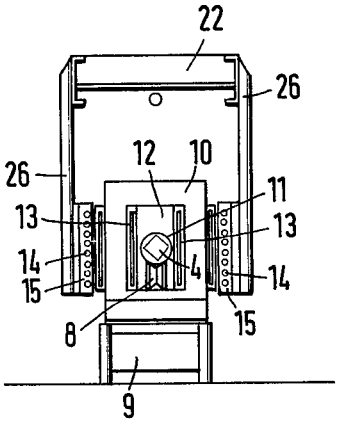

FIGS. 5 and 6 are views similar to those of FIGS. 1 and 2, respectively, of another embodiment of the invention wherein the electrode carriers are suspended on a frame disposed at a fixed elevation FIGS. 7 and 8 are cross-sectional views, respectively, of FIG. 5, taken along the respective lines VII—VII and VIII—VIII in the direction of the arrows;

FIGS. 9 and 10 are also views similar to those of FIGS. 1 and 2, respectively, of a third embodiment of the invention wherein the frame is adjustable in elevation; and FIGS. 11 and 12 are cross-sectional views, respectively, of FIG. 9, taken along the respective lines XI—XI and XII—XII in the direction of the arrows.

Referring now to the drawing and first, particularly, to FIGS. 1 to 4 thereof, there is shown a heating apparatus wherein electrode carriers 1 are provided with rollers 2 on the undersides thereof. The rollers 2 run on tracks or rails 3 that are disposed on the plant or shop floor parallel to the travel path of the workpiece 4.

The electrode carriers 1 are displaceable by conventional means toward and away from each other in axial direction of the workpiece 4, so as to be able to adjust the length of the section being heated, if a workpiece is to be heated in continuous or once-through operation.

Figure 3:
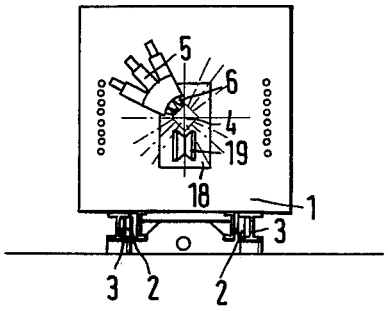
FIGS. 3 and 4 are cross-sectional views, respectively, of FIG. 1 taken along the respective lines III—III and IV—IV in the direction of the arrows.
Figure 4:
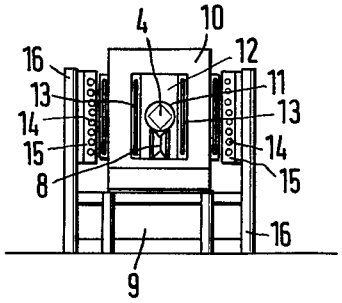

In such a case, the electrode carriers 1 are equipped with holders or sockets 5 for cylindrical or roll-type electrodes 6, which roll along on all sides of the workpiece 4, as shown by the radiating dash-dot lines in FIG. 3.

The path of travel of the workpiece 4 is indicated by the arrows associated with transport rollers 7 in FIG. 1, the rollers 7 being disposed outside the heating device of the invention. Additional transport rollers 8, only one of which is shown in FIG. 1, are provided between transformers 10 that are mounted on a pedestal 9. The one illustrated roller 8 and heat insulation 11, which surrounds the workpiece 4 inside the transformers 10, are visible in FIG. 1 at the broken-away section in the region of the transformers 10.

The transformers 10 have equal power rating and are aligned so that the centers of the windows or cut-outs 12 thereof lie on the axis of the workpiece 4. The transformers 10 are, furthermore, connected in parallel with the supply network and have primary windings 13 on the vertical legs thereof, as shown in FIG. 1. Fixedly installed, water-cooled tubular current conductors 14 extend parallel to the workpiece 4 outside the transformers 10 and close to the primary windings 13 thereof. The current conductors 14 are held in place by insulating bodies 15 which are connected to columnar supports 16 erected on the shop floor. In the region of the electrode carriers 1, the tubular current conductors 14 are connected to flexible, hollow conductor elements 17, FIG. 2, which are connected to the holders or sockets 5 of the electrodes 6.

In cutouts 18 formed therein, the electrode carriers 1 have guide rollers 19 which are adjustable in elevation and by means of which the workpiece passing through the heating device of the invention can be brought into a coaxial or concentric position with the circular array of holders or sockets 5 of the electrodes 6.

In the second embodiment of the invention according to FIGS. 5 to 8, the heating device is formed of two supporting structures 20 having arms 21. To the latter a frame 22, is attached having tracks or rails 23 for receiving thereon rollers 25 that are disposed on and secured to the upper sides of the electrode carriers 24.

In this embodiment, also, the electrode carriers 24 are displaceable for adjusting the length of the workpiece section being heated, when the heating operation is continuous or once-through.

Also mounted on the frame 22, are holders 26 for the insulating bodies 15, with which the tubular current conductors 14 are fixed.

The disposition and construction of the transformers 10 as well as the secondary circuits thereof are the same as in FIGS. 1 to 4. Accordingly, those parts in FIGS. 5 to 9 corresponding to like parts in FIGS. 1 to 4 are identified by the same reference numerals. This applies as well to the corresponding parts of the third embodiment of the invention as shown in FIGS. 9 to 12.

In the heating apparatus of the embodiment of FIGS. 9 to 12, arms 27 carrying the frame 22 are fastened to lifting columns 28, which are guided through the aid of guide rollers 29 in supporting structures 30 and are movable upwardly and downwardly through the aid of differenrial cylinders 31 by hydraulic or pneumatic means.

With these lifting columns 28, in the case of cyclic or periodic operation, if stationary electrodes 32 must be applied, in the case of workpieces having large cross sections, to the end faces of those workpieces, in addition to the ends of the outer cylindrical surfaces thereof, it is possible to raise the electrodes 32 together with the holders 33 thereof as well as with the electrode carriers 24 so far that, when changing workpieces, the latter can be displaced in longitudinal direction thereof over the guide rollers 34 through recesses 35 formed in the electrode carriers 24.

In the embodiment of the invention illustrated in FIGS. 9 to 12, the electrode carriers 24 are likewise displaceable in axial direction of the workpiece 4 by rollers 25, which are attached to the electrode carriers 24 at the top thereof, the tracks or rails 23 being secured to the frame 22 for the rollers 25. The electrode carriers 24 are thus displaceable in order to equalize length differences among the individual workpieces and to be able to apply the electrodes 32 at the end faces of the workpieces.

In the embodiment of FIGS. 9 to 12, the insulating bodies 15 which hold the tubular current conductors 14 in place are fastened in the same manner, as is herein described in connection with the embodiment of FIGS. 5 to 8, to the holders 26 which are rigidly connected to the frame 22.

It is apparent from the aforediscussed embodiments of the conductive heating apparatus according to the invention, that the secondary windings for all of the transformers 10 are formed by the workpiece 4, lying in the cutouts or windows 12 of the transformers 10, the electrodes 32 which, in cycled or periodic operation, rest firmly on the workpiece 4, near the ends thereof, or the electrodes 6 which roll on the workpiece and which, during continuous or once-through operation, are disposed with clearance along the length of the section being heated, the flexible hollow conductor elements 17; and the tubular current conductors 14, since all of these parts i.e. the workpiece 4, the electrodes 32 or the electrodes 6, the conductor elements 17 and the conductors 14, are connected electrically conductively to one another.

The advantages attained by the invention are, in particular, the relatively simple mechanical construction of the heating device, the assembly thereof on the shop or plant floor without any pit, and the use of several mass-produced transformers of equal power rating, the number of which depending upon the length of the workpiece or the section thereof being heated; as well as the less costly construction of the transformers compared to the cost of heretofore known transformer, due to the fact that the tranformers according to the invention have no added secondary windings.

There are claimed:

1. In apparatus for resistance-heating elongated workpieces by direct passage of current therethrough, a device for displacing the elongated workpieces longitudinally into and out of the apparatus comprising rail means providing a transporting surface into and out of the apparatus, electrode carriers having rollers rollably supporting said electrode carriers on said rail means, and drive means for driving said electrode carriers along said rail means in axial direction of a respective workpiece, a plurality of serially disposed transformers of equal power rating formed with respective windows having centers disposed on an axis coinciding with the longitudinal axis of a workpiece when the latter is being resistance-heated in the apparatus, said transformers having primary windings on opposite legs thereof, the workpiece extending through said windows of said transformers and being connected at the ends thereof to said transformers by electrodes engaging said workpiece and supported by said electrode carriers, flexible conductor elements which are connected to tubular current conductors, said tubular current conductors being disposed substantially parallel to the longitudinal axis of the workpiece and being located outside said transformers at a minimal proximate distance therefrom, said tubular current conductors, flexible conductor elements, electrodes and workpiece constituting secondary windings for said transformers.

2. Apparatus according to claim 1 including means for carrying said tubular current conductors, said carrying means having insulating bodies respectively holding said tubular current conductors in place on said carrying means.

3. Apparatus according to claim 1 wherein said transformers have thermal insulation within said windows thereof in vicinity of the respective primary windings for insulating the latter with respect to the workpiece.

* * * * *